United States Patent [19]

Bud et al.

[11] 3,977,599

[45] Aug. 31, 1976

[54] COUNTING DEVICES

[75] Inventors: Hans Bud, London; Peter Alway, Bushey, both of England

[73] Assignee: Hans Bud, London, England

[22] Filed: May 16, 1975

[21] Appl. No.: 578,341

[30] Foreign Application Priority Data

May 22, 1974 United Kingdom ..... 22946/74

[52] U.S. Cl. ..... 235/144 HC; 235/133 R; 235/144 SM

[51] Int. Cl.[2] ..... G06C 15/42

[58] Field of Search ..... 235/133 R, 139 R, 144 R, 235/144 HC, 144 S, 144 SS, 144 SM, 144 SP, 117 R

[56] References Cited

UNITED STATES PATENTS

| | | | |
|---|---|---|---|
| 3,244,368 | 4/1966 | Juhas | 235/144 HC |
| 3,357,637 | 12/1967 | Stautmeister | 235/144 HC |
| 3,494,549 | 2/1970 | Spath | 235/144 HC |
| 3,596,067 | 7/1971 | Wahl | 235/144 HC |
| 3,878,732 | 4/1975 | Kubler | 235/144 HC |

*Primary Examiner*—L. T. Hix
*Assistant Examiner*—Vit N. Miska
*Attorney, Agent, or Firm*—Browdy and Neimark

[57] ABSTRACT

A counting device of the kind having coaxial number wheels each with a reset cam and transfer pinions mounted on a shaft which is displaceable relatively to the number wheels the pinions being located between successive number wheels with each pinion meshing with gear teeth on an adjacent number wheel and adapted to engage drive means on the other adjacent number wheel so as partially to rotate the number wheel with which it is in mesh. Reset fingers are provided which are together rotatable about a common axis respectively to engage with the reset cams to reset the number wheels, the reset fingers and transfer pinions being located, prior to resetting, respectively out of engagement with the reset cams and in engagement with the gear teeth on the number wheels. A reciprocably movable actuating member is also provided to effect resetting of the number wheels during movement in one sense and upon movement in the reverse sense is repositioned for subsequent resetting action. A cam element is provided which is rotatable relatively to the number wheel axis during an initial part of the resetting movement of the actuating member to effect displacement of the transfer pinion shaft to disengage the pinions from the gear teeth on the number wheels, and, abutment means are fixed relatively to the reset fingers and adapted during a subsequent part of the resetting movement of the actuating member to reverse the rotation of the cam element so that after resetting of the number wheels and while the reset fingers are engaged with the reset cams, return movement of the transfer pinions with the gear teeth on the number wheels is effected.

16 Claims, 13 Drawing Figures

COUNTING DEVICES

Figure 1:
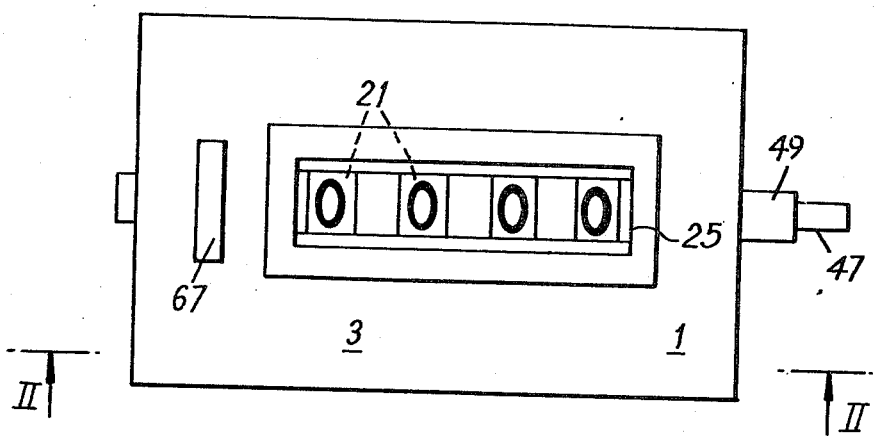

This invention relates to counting devices and more particularly to such devices of the kind comprising a counter having coaxial rotatable number wheels, a reset cam provided with each number wheel to rotate therewith, transfer pinions, a shaft on which the transfer pinions are rotatably mounted and which is displaceable relatively to the number wheels, the pinions being disposed respectively intermediate successive number wheels, each pinion meshing with gear teeth on one of the number wheels adjacent thereto and adapted to engage drive means on the other number wheel during rotation of said other number wheel thereby partially to rotate said one of the number wheels, reset fingers together rotatable about a common axis to engage respectively with the reset cams to reset the number wheels, the reset fingers and the transfer pinions being located, prior to re-setting, respectively out of engagement with the reset cams and in engagement with the gear teeth on the number wheels, and a reciprocably movable actuating member adapted to effect resetting of the number wheels during movement thereof in one sense by rotation of the reset fingers and upon movement in the reverse sense to be repositioned for subsequent resetting action.

One form of counter device of the kind set forth is provided with reset mechanism for resetting the number wheels which effects retraction of the transfer pinions from the number wheels and then engagement between the reset fingers and the reset cams to reorientate the number wheels. The reset fingers then disengage the reset cams and the transfer pinions are subsequently brought into mesh again with the gear teeth on the number wheels. Accordingly, during the resetting action there is a period during which there is neither engagement between the reset cams and the reset fingers nor between the transfer pinions and the number wheel gear teeth. Because of this undesirable movement of the number wheels may take place and, in consequence, faulty resetting may occur.

Where counters of the kind described have in the past been proposed in which the reset fingers remain engaged with the reset cams whilst the transfer pinions re-engage the number wheel gear teeth, they have been characterised by mechanical complexity and the power requirement for the resetting action has been undesirably high.

It is an object of the present invention to provide in a counting device of the kind set forth improved reset mechanism.

The present invention consists in a counting device of the kind set forth wherein a cam element is rotatable relatively to the number wheel axis during an initial part of the resetting movement of the actuating member to effect displacement of the transfer pinion shaft to disengage the pinions from the gear teeth on the number wheels, and, abutment means are fixed relatively to the reset fingers and adapted during a subsequent part of the resetting movement of the actuating member to reverse the rotation of the cam element so that after resetting of the number wheels and whilst the reset fingers are engaged with the reset cams, return movement of the transfer pinion shaft with consequent re-engagement of the transfer pinions with the gear teeth on the number wheels is effected.

Advantageously, the cam element and actuating member are provided with respective complementary parts which prior to resetting action of the actuating member are mutually engaged and are disengaged at the end of said initial part of the resetting movement of the actuating member to effect displacement of the transfer pinion shaft and are re-engaged during return movement of the actuating member.

Suitably, the cam element is formed in its periphery with a groove in which prior to resetting movement of the actuating member is located an end of the transfer pinion shaft and spring means are provided which bias the transfer pinion shaft towards engagement with the groove of the cam element.

Preferably, means are provided which upon disengagement of the transfer pinions engage shaped features on the respective pinions to reorientate the pinions and thereby enable correct remeshing thereof with the gear teeth of the number wheels. Advantageously, the said means maintain engagement with the pinion features until completion of remeshing of the pinions and are thereafter disengaged from said features.

Figure 2:
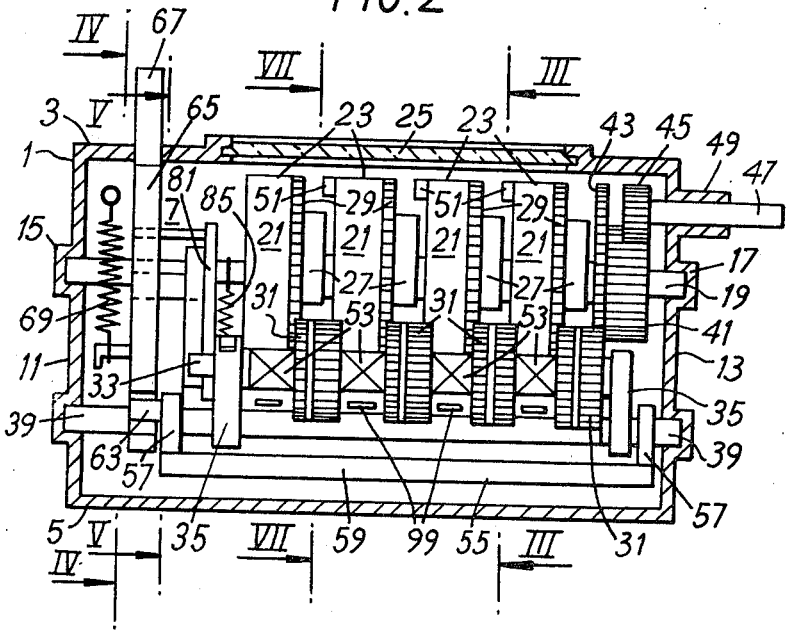
Figure 3:
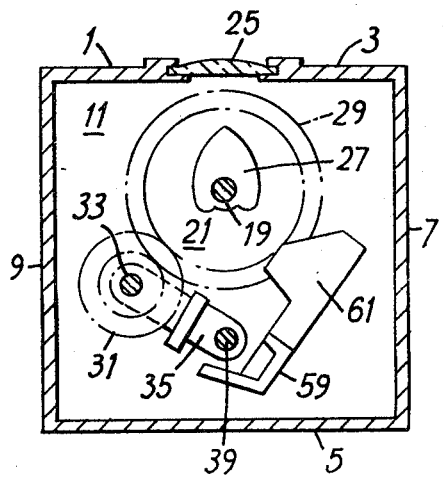
Figure 4:
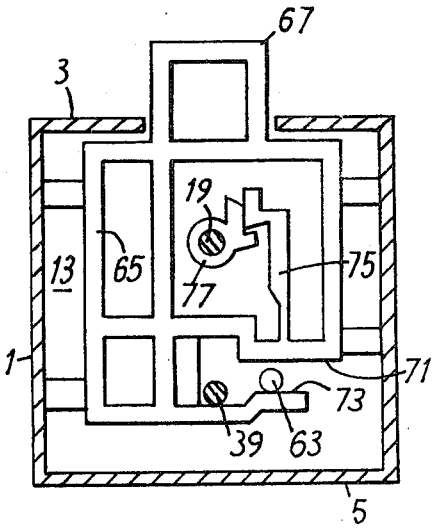
Figure 5:
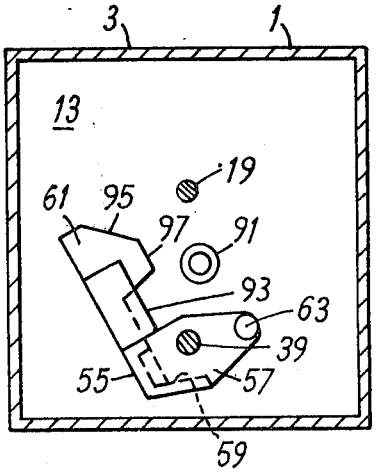
Figure 6:
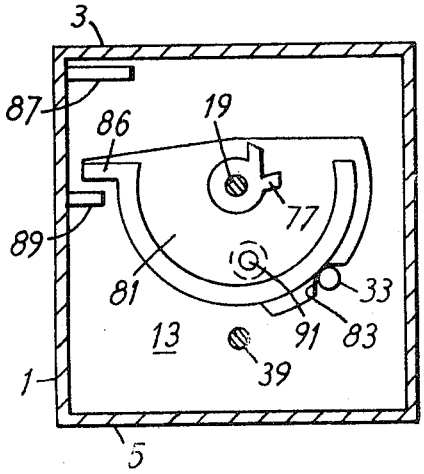
Figure 7:
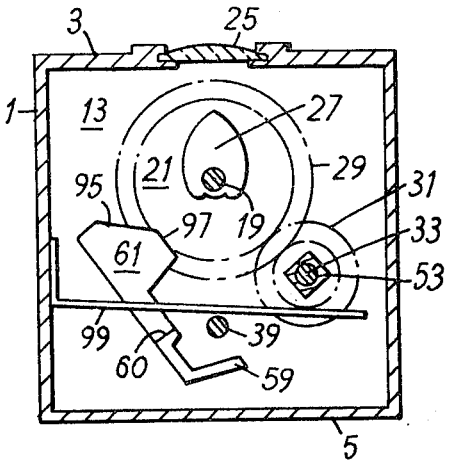
Figure 8:
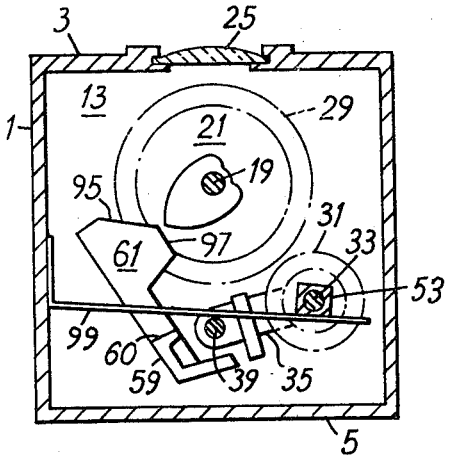
Figure 9:
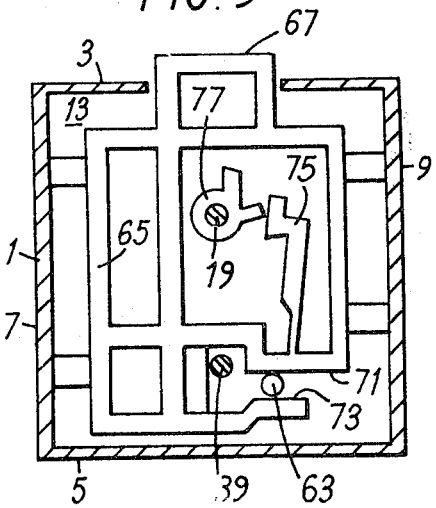
Figure 10:
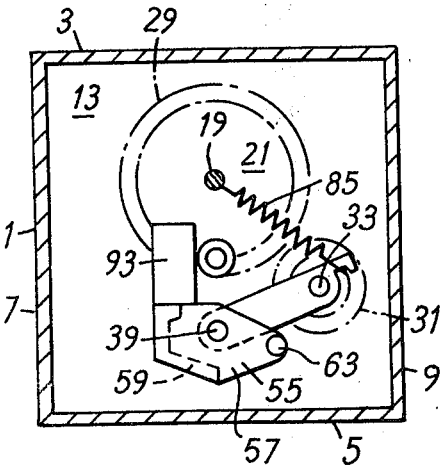
Figure 11:
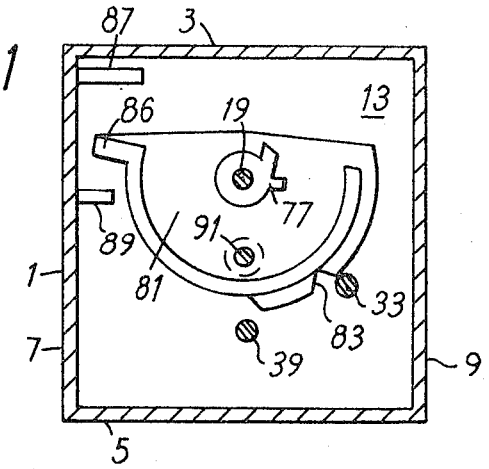
Figure 12:
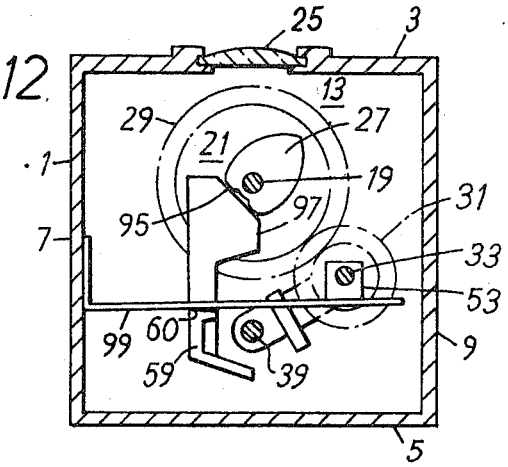
Figure 13:
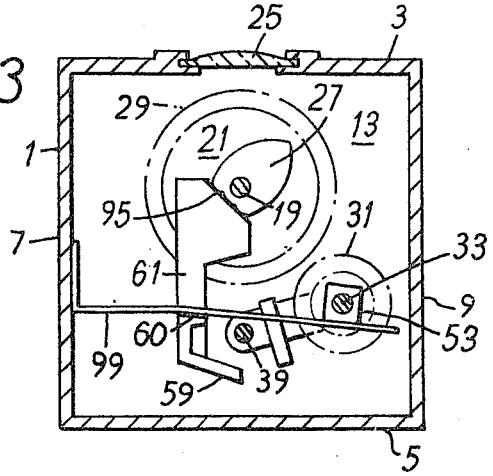

The invention will now be described, by way of example, with reference to the accompanying drawings in which:

FIG. 1 is a plan view of an embodiment of a counter device according to the invention, FIG. 2 is a sectional elevation on the line II—II of FIG. 1, FIG. 3 is a cross-sectional view with certain parts omitted on the line III—III of FIG. 2, FIG. 4 is a sectional view with certain parts omitted on the line IV—IV of FIG. 2 prior to resetting operation, FIGS. 5 and 6 are sectional views each taken on the line V—V of FIG. 2 and each has parts omitted so as clearly to illustrate the relationship between certain elements of the counting device, FIGS. 7 and 8 are sectional views on the line VII—VII showing different possible positions of parts of the device prior to and during resetting operation, FIG. 9 is a view similar to FIG. 4 but showing a position of parts during resetting of the device, FIG. 10 is a view taken out in line V—V of FIG. 2 of certain parts of the device in a position reached during resetting of the device, FIG. 11 is a view similar to FIG. 6 showing a position of parts of the device during resetting thereof, and FIGS. 12 and 13 are views similar to FIGS. 7 and 8 illustrating parts of the device at different times during resetting thereof.

Referring to the drawings, a counter device in the form of a decade counter comprises a body 1 of generally rectangular cross-section defined by upper and lower walls 3 and 5 upright side walls 7 and 9 and end walls 11 and 13. End walls 11 and 13 are formed with recesses 15 and 17 in which are journalled ends of a shaft 19 on which are freely rotatably mounted number wheels 21 each formed with a series of numbers on an outer cylindrical surface 23 thereof. In upper wall 3 is disposed an elongate window 25 through which a number on the part of each wheel immediately below the window can be observed. The wheels accordingly as viewed through window 25 provide a sequence of numbers which represent the count of the device.

On a side of each number wheel 21 is formed integrally therewith a coaxial reset cam 27 which is substantially heart shaped and outwardly of the cam is formed a ring 29 of gear teeth. The rings 29 of gear teeth each mesh with a pinion 31 freely rotatably mounted on a shaft 33 the ends of which are pivotally carried on respective arms 35 which remotely, from shaft 33 are respectively mounted on ends of a shaft 39 journalled in recesses in the end walls 11 and 13.

At an end of the row of number wheels 21 there is rotatably mounted on the number wheel shaft 19 a pair of coaxial gears 41 and 43 of different diameters which are formed in one and of which the smaller diameter gear 41 meshes with a pinion 45 on a shaft 47 which extends through a bearing 49 formed in end wall 13 to an external drive mechanism. The larger gear 43 meshes with pinion 31 at the corresponding end of the row of pinions on shaft 33 and the same pinion 31 engages the ring 29 of gear teeth on number wheel 21 adjacent the pair of gears 43 and 41. It will be apparent, accordingly, that as the external drive is operated to rotate pinion 45, gears 41 and 43 are rotated and pinion 31 in mesh with gear 43 thereby effects rotation of adjacent number wheel 21.

The faces of the number wheels which are opposed respectively to rings 29 of gear teeth each on an adjacent number wheel 21 are formed each with a tooth element 51 which at the completion of each revolution of the associated number wheel effects a partial rotation of the pinion 31 in mesh with the ring 29 of gear teeth on the adjacent number wheel 21 so that that number wheel rotates through one tenth of a revolution. Thus, in operation, successive wheels 21 from the gear pair 41 and 43 rotate stepwise one tenth of the rotation of the preceding wheel, the steps of rotation occurring on completion of a revolution of the preceding wheel.

Each of the pinions 31 is formed with a laterally extending boss 53 of square cross-section the purpose of which is hereinafter described.

The shaft 39 also has rotatably mounted thereon a cradle 55 having end members 57 rotatably engaged on shaft 39 and a longitudinal member 59 which extends between the end members. Extending from longitudinal member 59 are upwardly extending fingers 61 which upon rocking of cradle 55 respectively engage and rotate cams 27 to reset the number wheels 21. The end member 57 remote from gear pair 41 and 43 extends on opposite sides of the plane of symmetry of the device which contains the axes of shafts 19 and 39 and the fingers 61 are disposed to one side of the plane of symmetry. On the other side of the plane of symmetry, the end member 57 remote from gear pair 41 and 43 is provided with an abutment 63 which extends parallel with shaft 39 towards end wall 11.

The abutment 63 is engageable with an actuating member 65 for resetting number wheels 21. Member 65 is in the form of an apertured slide which is flat and extends and is constrained for movement parallel with end walls 11 and 13. An upper end of member 65 projects through the upper housing wall 3 to afford reset button 67 which can be depressed to move member 65 against the action of a biassing spring 69 anchored at opposite ends thereof respectively to the housing and the member 65.

The abutment 63 projects between upper and lower jaws 71 and 73 formed integrally with actuating member 65 and in the uppermost position of the member 65 (see FIG. 4) jaw 71 is located a short distance above abutment 63 so that only after an initial movement of member 65 does the latter engage the abutment and cause rocking of cradle 55 to effect engagement between fingers 61 and cams 27. It will be noted that apertures in actuating member 65 prevent engagement of the member during reciprocation thereof with either of shafts 19 or 39.

The actuating member 65 is formed with an upstanding pawl 75 which can flex laterally in the plane of the member 65 and which in the uppermost position of member 65 engages a ratched 77 on shaft 19. Movement of member 65 to effect resetting rotates ratchet 77 through a small angle, approximately 25° until the pawl is disengaged. During return movement of the actuating member, the stroke of which is about 3 mm, the influence of spring 69 effects re-engagement between ratchet 77 and pawl 75.

Mounted on shaft 19 for rotation with ratchet 77 is a cam element 81 in a cylindrical surface of which is a longitudinally extending groove 83 in which pinion shaft 33 is located, shaft 33 being biassed into engagement with groove 83 by a spring 85 anchored at opposite ends to shaft 19 and arm 35. On depression of actuating member 65 the rotation of ratchet 77 causes rotation of cam element 81 which displaces shaft 33 out of groove 83 on to the periphery of cam element 81 thereby to effect disengagement of pinions 31 from number wheels 21 fingers 61 of cradle 55 can engage cam 27 prior to rocking of cradle 55.

The cam element 81 is formed with an abutment 86 which upon rotation of the cam element in opposite senses may engage respective stops 87 and 89 on the housing 1 to limit travel of the cam element and thereby prevent its moving to a position in which it is out of synchronisation with other parts of the mechanism. Also, on cam element 81 is a boss 91 which upon rotation of cam element 81 is engaged by an abutment 93 provided on cradle 55. Engagement between boss 91 and abutment 93 reverses rotation of cam element 81 until fingers 61 engaging cams 27 have moved number wheels 21 to the reset position shown in FIG. 13. Cam element 81 is then in the position shown in FIG. 11 to allow spring 85 to rotate cam element 81 to its original position and pinion shaft 33 to be restored into groove 83.

Throughout the resetting operation contact as will be apparent is maintained between shaft 33 and the cam element 81 either in groove 83 or at the cam element periphery.

It will be noted that each finger 61 is formed with faces 95 and 97 one or other of which engages the corresponding cam 27 during resetting. The disposition of faces 95 and 97 ensures that whatever the point of engagement of cam 27 with the faces, finger 61 exerts a force on cam 27 which will cause the required cam rotation so that jamming of the cam and finger is prevented.

When, during resetting, shaft 33 is swung to disengage pinions 31 from wheels 21, bosses 53 on pinions 31 engage respective leaf springs 99 which are secured at corresponding ends thereof to housing side wall 7 and which extend across the housing towards wall 9. Upon engagement between springs 99 and bosses 53 the pinions rotate freely untl one of the four flat faces of each boss contacts the corresponding spring 99. The pinions are thereby reorientated to ensure proper re-engagement thereof with the gear rings 29. It will be noted that when cradle 55 has been fully rocked during resetting to the position shown in FIG. 12 or 13, the top side 60 of longitudinal cradle member 59 engages the underside of leaf springs 99 between wall 7 and the point of engagement of the springs and the bosses 53 so that the springs are stressed to ensure that when, upon reversal of the cam element 81 and consequent movement back of shaft 33 into groove 83, the springs maintain engagement with bosses 53 until pinions 31 mesh with gear rings 29 (see FIG. 12). In this way correct orientation of the pinions is maintained throughout their return travel into mesh with gear rings 29 after which meshing and upon release of actuating member 65, causing return of cradle 55, the springs 99 flex out of contact with the bosses 53 and assume their original position as shown in FIG. 7.

The overal resetting operation of the mechanism can now be appreciated. Upon depressing button 67 of the actuating member the pawl 75 rotates ratchet 77 and therefore cam element 81 so that pinions 31 are driven out of mesh with gear rings 29 and bosses 53 engage springs 99 properly to orientate the pinions irrespective of their angular position at the time of disengagement from gear rings 29. Spring 85 is slightly extended and maintains pinion shaft 33 biassed towards cam element 81. On continued depression of button 67 jaw 71 engages abutment 63 to rock cradle 55 and the pawl 75 disengages from the ratchet 77. Cradle 55 is rocked until, through engagement of fingers 61 and reset cams 27, number wheels 21 are reset and springs 99 are stressed by top side 60 of member 59, whilst through engagement of abutment 93 and boss 91, the cam element 81 is partially reversed and the shaft 33 is pulled back under bias of spring 85 into groove 83 to complete the reversal of the cam during which motion the springs 99 carry through in contact with the bosses to keep the attitude of the pinions suitable for re-engagement. The pinions are thus re-engaged whilst the number wheels are held against movement in their re-set position and whilst springs 99 ensure correct re-meshing of the pinions. Button 67 is now released whereupon actuating member 65 returns under the bias of spring 69 and during its return movement jaw 73 engages abutment 63 and returns cradle 55 to its initial position so that springs 99 disengage bosses 53. The pawl 75 also re-engages ratchet 77 and the mechanism has accordingly been restored to its initial position suitable for a further counting and resetting cycle.

Whilst reorientation of the pinions and remeshing thereof in correct alignment has been described in connection with the engagement of springs 99 with bosses 53, it will be appreciated that features of the pinions other than bosses, indeed the pinion teeth themselves could be engaged by complementarily shaped springs or other flexible or flexibly mounted members.

The short stroke of actuating member 65 and consequent small extension of spring 69 together with the small displacement required for pinion shaft 33 and attendant small extension of spring 85 ensure power requirement for resetting of the counter is particularly small.

It should be noted as regards the power requirement for resetting that this is kept low by displacing the pinion shaft in a first part of the resetting action of the actuating member from the groove 83 to the periphery of cam element 81 and effecting zeroing of the number wheels in a second part of the resetting action during which since ratchet 77 and pawl 75 are disengaged power is not required to keep spring 85 extended. Thus the power requirement is not cumulatively increased during the resetting action.

I claim:

1. A counting device comprising a counter having coaxial rotatable number wheels, a reset cam provided with each number wheel to rotate therewith, transfer pinions, a shaft on which the transfer pinions are rotatably mounted and which is displaceable relatively to the number wheels, the pinions being disposed respectively intermediate successive number wheels, each pinion meshing with gear teeth on one of the number wheels adjacent thereto and adapted to engage drive means on the other number wheel during rotation of said other number wheel thereby partially to rotate said one of the number wheels, reset fingers together rotatable about a common axis to engage respectively with the reset cams to reset the number wheels, the reset fingers and the transfer pinions being located, prior to resetting, respectively out of engagement with the reset cams and in engagement with the gear teeth on the number wheels, and a reciprocably movable actuating member adapted to effect resetting of the number wheels during movement thereof in one sense by rotation of the reset fingers and upon movement in the reverse sense to be repositioned for subsequent resetting action, characterised in that a cam element is rotatable relatively to the number wheel axis during an initial part of the resetting movement of the actuating member to effect displacement of the transfer pinion shaft to disengage the pinions from the gear teeth on the number wheels, and abutment means are fixed relatively to the reset fingers and adapted, during a subsequent part of the resetting movement of the actuating member, to reverse the rotation of the cam element so that after resetting of the number wheels and whilst the reset fingers are engaged with the reset cams return movement of the pinion shaft with consequent re-engagement of the transfer pinions with the gear teeth on the number wheels is effected.

2. A counting device as claimed in claim 1, characterised in that the cam element and actuating member are provided with respective complementary parts which prior to resetting action of the actuating member are mutually engaged and are disengaged at the end of said initial part of the resetting movement of the actuating member to effect displacement of the transfer pinion shaft and are re-engaged during return movement of the actuating member.

3. A counting device as claimed in claim 1, characterised in that the cam element is formed in its periphery with a groove in which prior to resetting movement of the actuating member is located an end of the transfer pinion shaft and spring means are provided which bias the transfer pinion shaft towards engagement with the groove of the cam element.

4. A counting device as claimed in claim 1, characterised in that the cam element is formed with an abutment which extends between a pair of stops on the device body adapted to limit rotational travel of the cam element in opposite senses.

5. A counting device as claimed in claim 1, characterised in that the cam element is provided with a reversal abutment which is engaged by the abutment means fixed relatively to the reset fingers to reverse the rotation of the cam element effected during the initial part of the resetting movement of the actuating member and thereby cause re-engagement of transfer pinions with the gear teeth on the number wheels whilst the reset fingers are engaged with the reset cams.

6. A counting device as claimed in claim 1, characterised in that the reset fingers and the abutment means fixed relatively thereto are supported on a cradle comprising parallel end members extending transversely with respect to the number wheel axis and a longitudinal member connected therebetween and on which the reset fingers and abutment means are mounted, the longitudinal member lying to one side of a pivotal axis of the end members coplanar with the number wheel axis.

7. A counting device as claimed in claim 1, characterised in that the resetting action of the device is effected with small reciprocal movements of the actuating member and cam element.

8. A counting device as claimed in claim 1, characterised in that means are provided which engage shaped features on the transfer pinions upon disengagement thereof from the number wheels and which reorientate the pinions thereby to enable correct remeshing thereof with the gear teeth of the number wheels.

9. A counting device as claimed in claim 2, characterised in that the complementary parts comprise a ratchet on the cam element and a pawl on the actuating member.

10. A counting device as claimed in claim 9, characterised in that the pawl is flexibly mounted on the actuating member for movement thereof, to disengage and re-engage the ratchet, in a direction transverse to the direction of reciprocal movement of the actuating member.

11. A counting device as claimed in claim 3, characterised in that the transfer pinion shaft is carried in corresponding ends of arms which spaced from said corresponding ends are pivotally supported with respect to a common axis and the spring means which bias the transfer pinion shaft towards engagement with the groove in the cam element comprise a helical spring connected at its ends respectively to one of said arms and to a central shaft on which the cam element is rotatable.

12. A counting device as claimed in claim 6, characterised in that on the side of one of the end members remote from the longitudinal member is an abutment and the actuating member is adapted during the resetting action thereof to displace the transfer pinion shaft and to engage said abutment to rotate the reset fingers and abutment fixed relatively thereto respectively into engagement with the reset cams and the cam element abutment.

13. A counting device as claimed in claim 6, characterised in that the transfer pinion shaft is parallel with and rotatable with respect to the rotational axis of the end members of the cradle.

14. A counting device as claimed in claim 8, characterised in that the means which engage the shaped features of the transfer pinions are adapted to maintain said engagement until completion of remeshing of the pinions and number wheels and thereafter are disengaged from the pinion features.

15. A counting device as claimed in claim 14, characterised in that the means which engage the shaped features of the transfer pinions comprise a plurality of leaf springs secured on the body of the device and extending on the side of the transfer pinions remote from the number wheels.

16. A counting device as claimed in claim 15, characterised in that means are provided which are adapted subsequently to engagement of the leaf springs with the transfer pinion features to stress the leaf springs thereby to ensure contact between the pinion features and the leaf springs is maintained until remeshing of the transfer pinions and number wheels takes place.

* * * * *